US010726817B1

(12) United States Patent
McIntyre

(10) Patent No.: US 10,726,817 B1
(45) **Date of Patent: *Jul. 28, 2020**

(54) APPARATUS FOR SOUND VOLUME REDUCTION

(71) Applicant: Kevin Joseph McIntyre, West Melbourne, FL (US)

(72) Inventor: Kevin Joseph McIntyre, West Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/215,253

(22) Filed: Dec. 10, 2018

Related U.S. Application Data

(63) Continuation-in-part of application No. 15/394,804, filed on Dec. 29, 2016, now Pat. No. 10,152,956.

(60) Provisional application No. 62/274,242, filed on Jan. 1, 2016, provisional application No. 62/439,446, filed on Dec. 27, 2016.

(51) Int. Cl.
*G10D 13/02* (2020.01)
*G10D 13/10* (2020.01)
*G10D 13/06* (2020.01)
*G10D 13/20* (2020.01)

(52) U.S. Cl.
CPC ..... *G10D 13/02* (2013.01); *G10D 13/10* (2020.02); *G10D 13/06* (2013.01); *G10D 13/20* (2020.02)

(58) Field of Classification Search
CPC ..... G10D 13/022
See application file for complete search history.

(56) References Cited

U.S. PATENT DOCUMENTS 10,152,956 B1 * 12/2018 McIntyre ..... G10D 13/022

* cited by examiner

*Primary Examiner* — Kimberly R Lockett
(74) *Attorney, Agent, or Firm* — Kenneth J. Lukacher Law Group; R. S. Rosenholm

(57) ABSTRACT

The invention provides an apparatus and method for reducing a volume of sound that travels away from a volume of space that is proximate to an instrument, while limiting an amount of physical contact with the instrument and limiting change to characteristics of the sound being produced by the instrument.

20 Claims, 12 Drawing Sheets

APPARATUS FOR SOUND VOLUME REDUCTION

CROSS REFERENCE TO RELATED PATENT APPLICATION(S)

This document is a U.S. non-provisional utility and a continuation-in-part (CIP) patent application, and that is a continuation-in-part of, and claims priority and benefit to, U.S. non-provisional patent application Ser. No. 15/394,804, which was filed on Dec. 29, 2016, and which is entitled "APPARATUS FOR SOUND VOLUME REDUCTION", and which is also referred to herein as the '804 patent application.

This '804 patent application claims priority and benefit under 35 U.S.C. 119 (e) to U.S. (utility) provisional patent application having Ser. No. 62/274,242, that was filed on Jan. 1, 2016 and that is entitled "SOUND MODIFIER", and which is incorporated herein by reference in its entirety.

This '804 patent application also claims priority and benefit under 35 U.S.C. 119 (e) to U.S. (utility) provisional patent application having Ser. No. 62/439,446, that was filed on Dec. 27, 2016 and that is entitled "APPARATUS FOR SOUND VOLUME REDUCTION", and which is also incorporated herein by reference in its entirety.

BACKGROUND OF THE INVENTION

Some musical instruments produce sounds that are considered too loud in some circumstances, when received by a human ear or by a microphone. For example, when playing percussion instruments in a small venue, such as by striking drums and cymbals. In some circumstances, being exposed to sound of a high volume is irritating to a listener and/or can cause damage to the hearing of a listener.

The discussion above is merely provided for general background information and is not intended to be used as an aid in determining the scope of the claimed subject matter.

BRIEF DESCRIPTION OF THE INVENTION

The invention provides an apparatus and method for altering one or more characteristics of sound that is produced by an instrument, while avoiding or substantially limiting (minimizing) an amount of physical contact between the apparatus and the instrument. In some embodiments, the apparatus is designed to reduce a volume of sound that is being transmitted away from a vicinity of an instrument, while also limiting change to other characteristics of the sound being produced by the instrument, and while minimizing physical contact between the apparatus and the instrument.

This brief description of the invention is intended only to provide an overview of subject matter disclosed herein according to one or more illustrative embodiments, and does not serve as a guide to interpreting the claims or to define or limit the scope of the invention, which is defined only by the appended claims.

BRIEF DESCRIPTION OF THE DRAWINGS

So that the manner in which the features of the invention can be understood, a detailed description of the invention to certain embodiments of the invention is provided herein, some of which are illustrated in the accompanying drawings. It is to be noted, however, that the drawings illustrate only certain embodiments of this invention and are therefore not to be considered limiting of its scope, for the scope of the invention can encompass other equally effective embodiments.

The drawings are not necessarily to scale. The emphasis of the drawings is generally being placed upon illustrating the features of certain embodiments of the invention. In the drawings, like numerals are used to indicate like parts throughout the various views. Differences between like parts may cause those parts to be indicated with different numerals. Unlike parts are indicated with different numerals. Thus, for further understanding of the invention, reference can be made to the following detailed description, read in connection with the drawings in which.

DETAILED DESCRIPTION OF THE INVENTION

Figure 1:
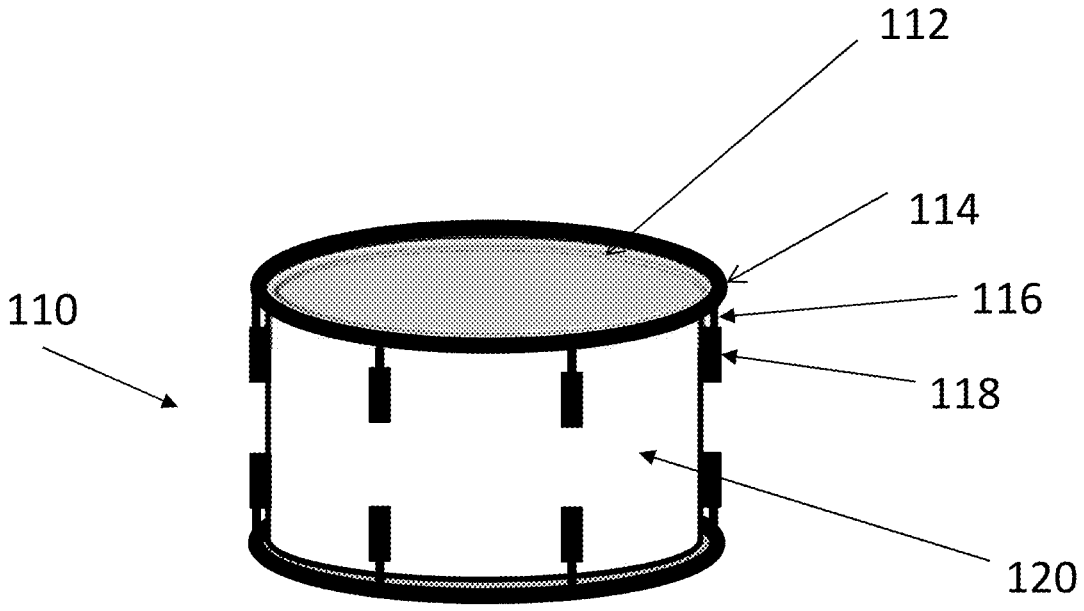
FIG. 1 illustrates an embodiment of a drum in an assembled and useable (playable) form.

FIG. 1 illustrates a side perspective view of an embodiment of drum 110 in an assembled and useable (playable) form. The drum 110 includes subcomponents including such as an upper drumhead 112 and an upper rim 114 that is designed to pull an outer edge of the upper drumhead 112 onto a drum shell 120. The upper rim 114 and the drumhead 112 are pulled over an upper outer edge of the drum shell 120 via a tightening of an upper lug screw 116. The upper lug screw 116 is rotationally attached to the upper rim 114 and rotationally attached to an upper lug 118. The lug screw 116 has exterior circular threads that are designed to engage interior circular threads disposed inside of the lug 118. The lug 118 is fixedly attached to an outer side of the drum shell 120.

Figure 2:
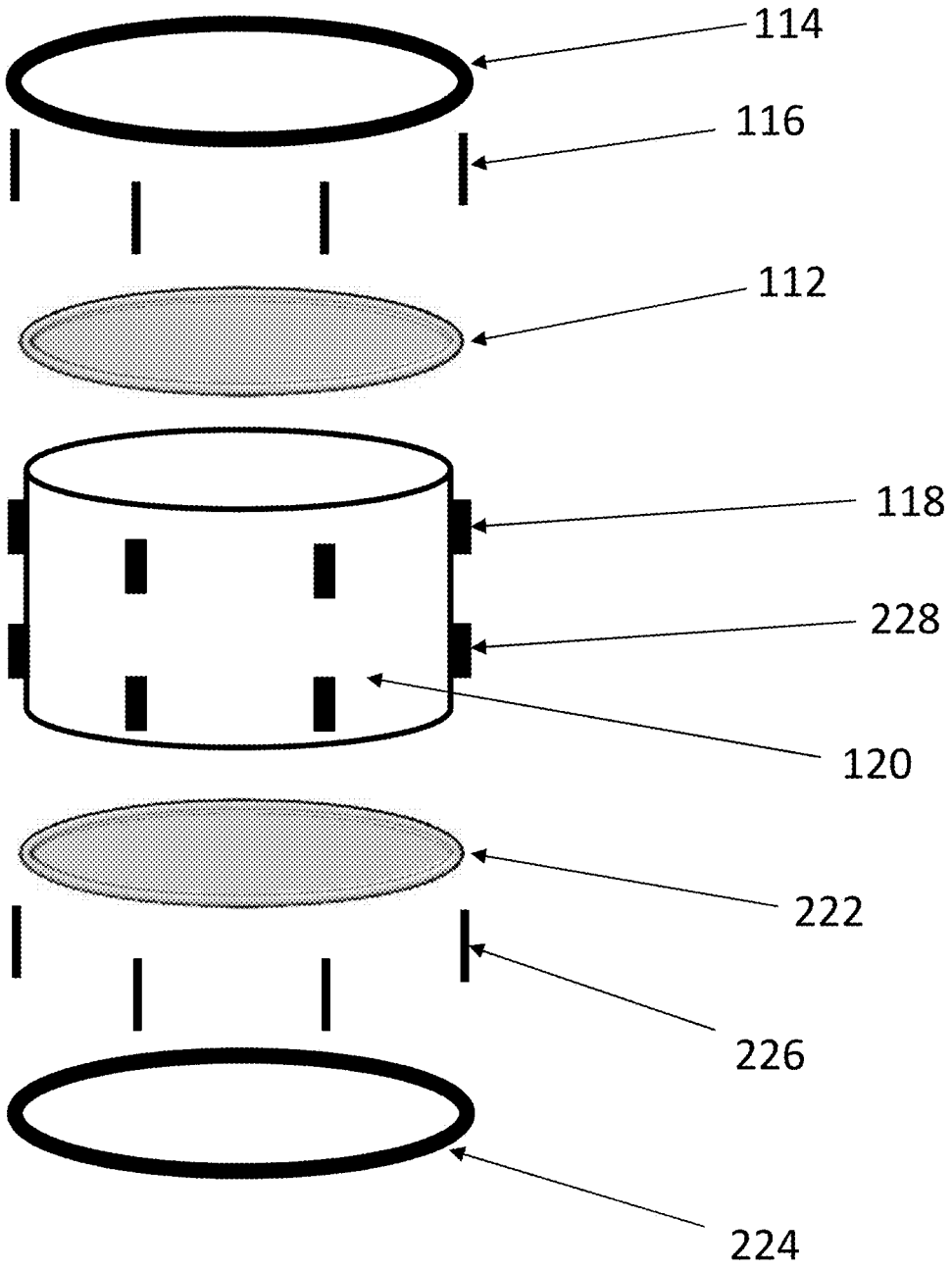
FIG. 2 illustrates an exploded view of the drum of FIG. 1 into its subcomponents.

FIG. 2 illustrates a side perspective and exploded view of the drum 110 of FIG. 1 into its subcomponents. As shown, in addition to the subcomponents identified for the drum 110 of FIG. 1, the drum 110 of FIG. 1 further includes a lower drumhead 222, a lower rim 224 and a lower lug screw 226 and a lower lug 228. The lower drumhead 222, lower rim 224, lower lug screw 226 and lower lug 228, function together like the upper drumhead 112, upper rim 114, upper lug screw 116 and upper lug 118 respectively, as described in association with FIG. 1.

Figure 3:
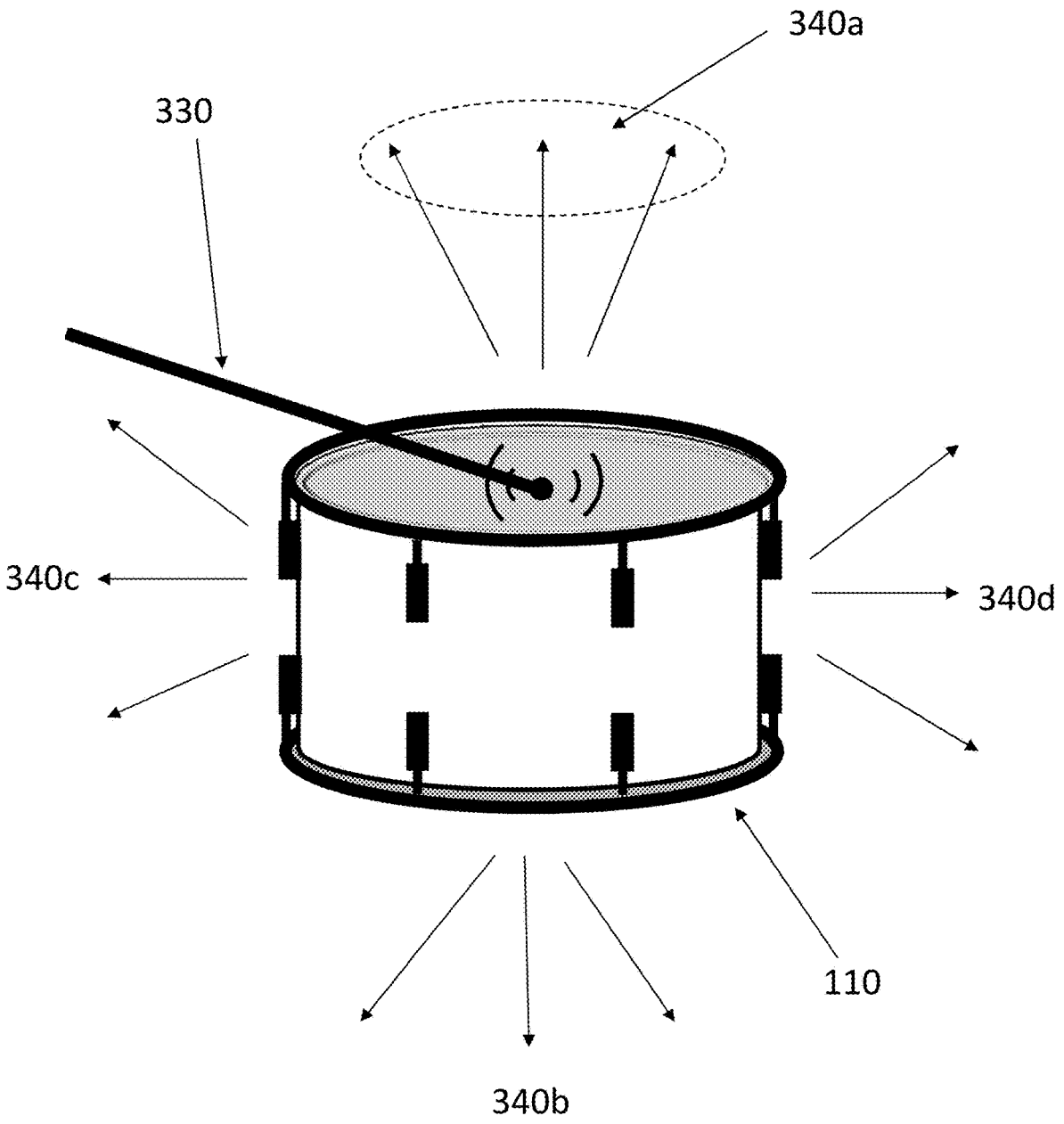
FIG. 3 illustrates acoustic energy (sound) transmitting away from the drum of FIGS. 1-2 when struck with a drumstick.

FIG. 3 illustrates generation and transmission of acoustic energy (sound) from the assembled drum 110 of FIG. 1, by striking the drum 110 with a drumstick 330. As shown, acoustic energy 340*a*-340*d* is generated and transmitted in various directions through the upper drumhead 112 and the lower drumhead 222, and through the drum shell 120. When struck, the drum 110 resonates. A resonating drum possesses a resonance frequency of a value that depends upon the design of the drum itself, and that depends upon the tension applied to the upper drumhead 112 and lower drumhead 222 via the lug screws 116, 226.

Figure 4:
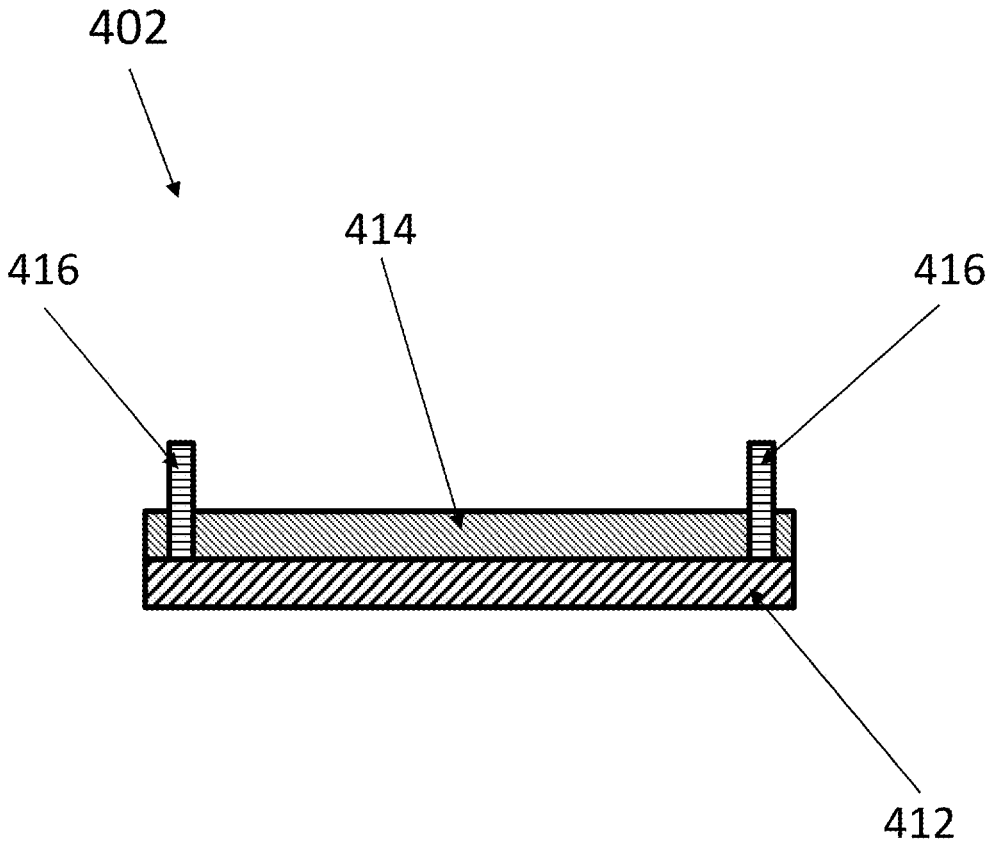
FIGS. 4-5 illustrate a first embodiment of the invention that is designed to reduce a volume of acoustic energy (sound) that transmits away from a vicinity of a drum, in response to striking the drum.
Figure 5:
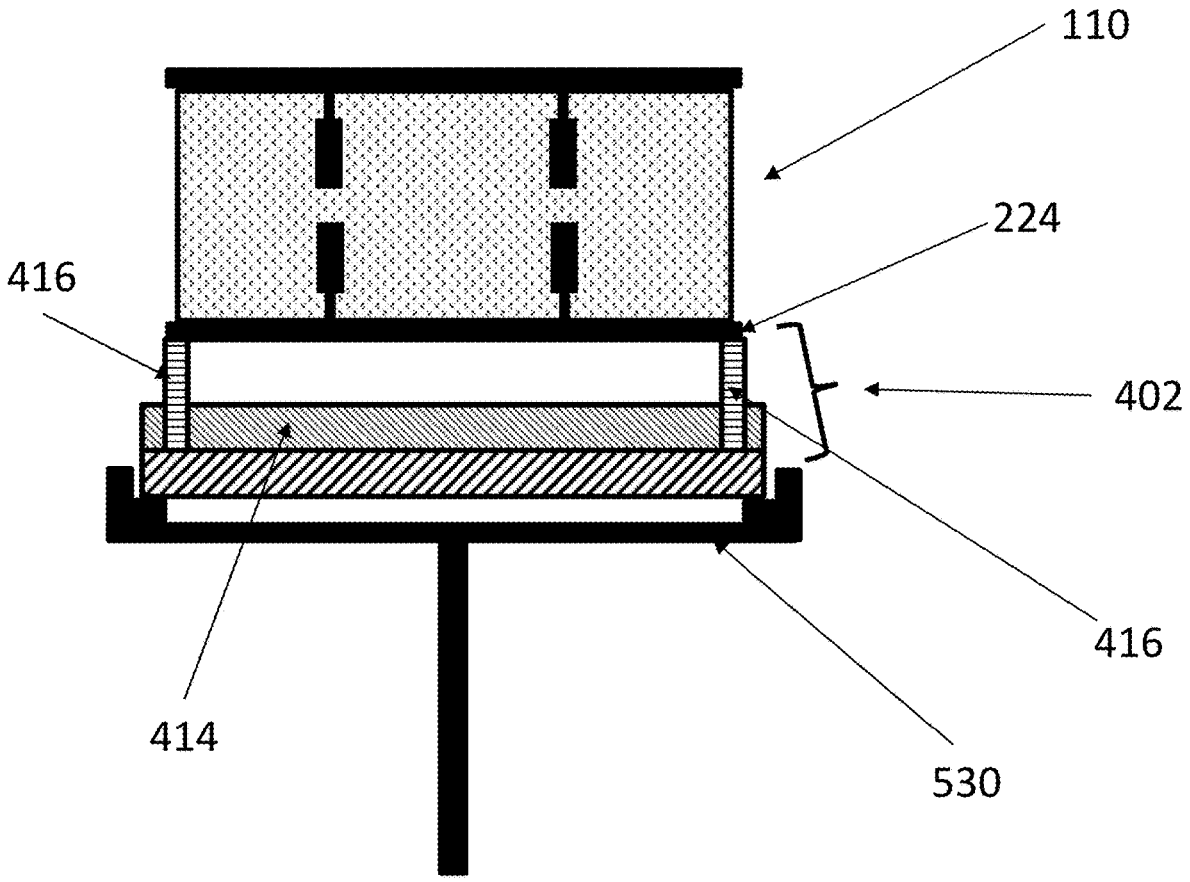

FIGS. 4-5 illustrate a first embodiment of the invention that is designed to reduce (attenuate) a volume of acoustic energy (sound) that transmits away from a vicinity of a drum, in response to striking the drum. The vicinity being volume of space that is located proximate, typically within a 0-6 inches, from a drum. Like other embodiments that are described within this document, this first embodiment is designed to reduce an amount of sound that is transmitted away from a drum, such as drum 110, while avoiding physical contact with either the upper drumhead 112 or lower drumhead 222 of the drum 110, in order to minimize a possible affect upon the resonance of the drum and to minimize a possible effect upon the characteristics of the sound generated by the drum 110. In other words, minimizing physical contact with the drumheads 112, 222 is intended to preserve characteristics of the sound that would otherwise be generated by the drum 110 when unmodified, and when the upper drumhead 112 is struck.

FIG. 4 is a side cross-sectional view of a sound absorbing component 414 that is disposed upon a base 412, while one or more separation components 416, also referred to herein as separators or spacers, are also disposed upon the base 412. This first embodiment 402 is cylindrical in overall shape, and designed to be disposed in close proximity to and below a lower drumhead 222 of a drum 110, and without making physical contact with the lower drumhead 222 of the drum 110. The shape of this embodiment 402 appears circular, when viewed either from a top-down viewing perspective, or when viewed from a bottom-up viewing perspective, both being perpendicular relative to this side cross-sectional viewing perspective. However, the design of this embodiment, and other embodiments disclosed herein, are not limited to such a circular shape. This first embodiment 402 is also designed to provide support from gravity to the drum 110, by making physical contact with the lower rim 224 of the drum 110. For example, a non-circular shape may be useful to allow the sound absorbing component to make physical contact with the lower drum rim, while fitting within maximum diameter constraints of a standard snare drum stand, so that this non-circular shaped base 402, can fit into and be used with a snare drum stand.

The sound absorbing component 414 is made from a sound absorbing material. Such material can be made from a rubber, a plastic or from fiber based material such as wood, and/or can be made from everyday household items, such as from a section of carpet flooring, for example. Ideally, sound absorbing material should possess physical properties that substantially attenuate sound within one or more acoustic frequency ranges. Such sound absorbing materials could be made from a variety of materials, including those classified in whole or in part, as foam, paper, plastic, rubber, insulation, metal, wool and/or a gel like substance, for example. The sound absorbing materials can include multiple (2 or more) layers that can be stacked or removed to customize the sound absorption characteristics. In addition to simply varying the overall amount of sound absorbing material, changing the number of layers can be used to intentionally change a thickness of an air gap between the drum head and said sound absorbing material. Changing the thickness of an air gap will alter the sound absorbing characteristics of the embodiment of the invention.

In some embodiments, the base 412 and the sound absorbing component 414 and the one or more spacer components 416 are constructed as one combined component. In some embodiments, this one combined component is shaped and dimensioned as a combination of the base 412 and the sound absorbing component 414 and the one or more spacer components 416, as shown in FIG. 4. In this type of embodiment, whether the combined component is shaped and dimensioned as shown in FIG. 4, or dimensioned and/or shaped otherwise, the base component 412 and the sound absorbing component 414 and the one or more spacer components 416 are made (constructed) as the same one component.

Likewise, in some embodiments, any pairing of any two of the base 412 and the sound absorbing component 414 and the one or more spacer components 416 are constructed as one combined component. In some embodiments, this one combined component is shaped and dimensioned as a pairing of any two of the base 412 and the sound absorbing component 414 and the one or more spacer components 416, as shown in FIG. 4. In this type of embodiment, whether the combined component is shaped as shown in FIG. 4, or dimensioned and/or shaped otherwise, the pairing of any two of the base component 412 and the sound absorbing component 414 and the one or more spacer components 416 are made (constructed) as the same one component.

As shown in FIG. 5, the lower rim 224 of the drum 110 is disposed upon and makes physical contact with the separation components 416 of the first embodiment of the apparatus 402 shown in FIG. 4. Also, the apparatus 402 of FIG. 4, is shown to be disposed upon a drum stand 530. As shown here, the separation components 416 provide support to the drum 110 from gravity. Although there is some physical contact between the separation components 416 and the lower rim 224 of the drum 110, the lower rim portion of the drum 110 contributes insignificantly to the resonance of the drum 110, when it is struck. In alternative embodiments, the separation components 416 can be configured to include a cavity, such as a crevice, that receives an outer edge of the lower rim 224 of the drum 110, so as to further restrict lateral movement of the drum 110, while it is disposed upon the apparatus 402 of FIG. 4.

Figure 6:
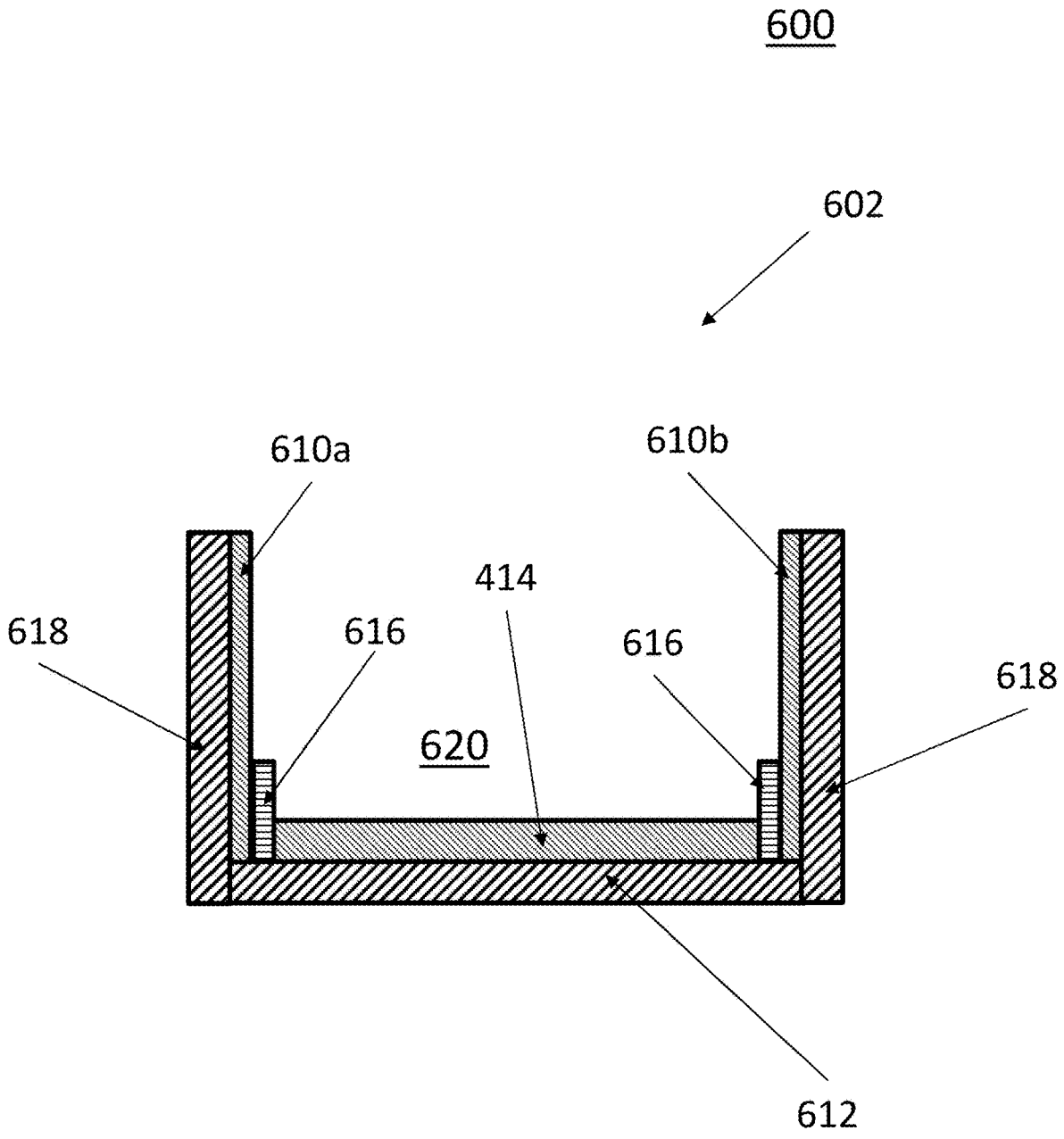
FIGS. 6-7 illustrate a second embodiment of the invention that is designed to reduce a volume of acoustic energy (sound) that transmits away from a vicinity of a drum, in response to striking the drum.
Figure 7:
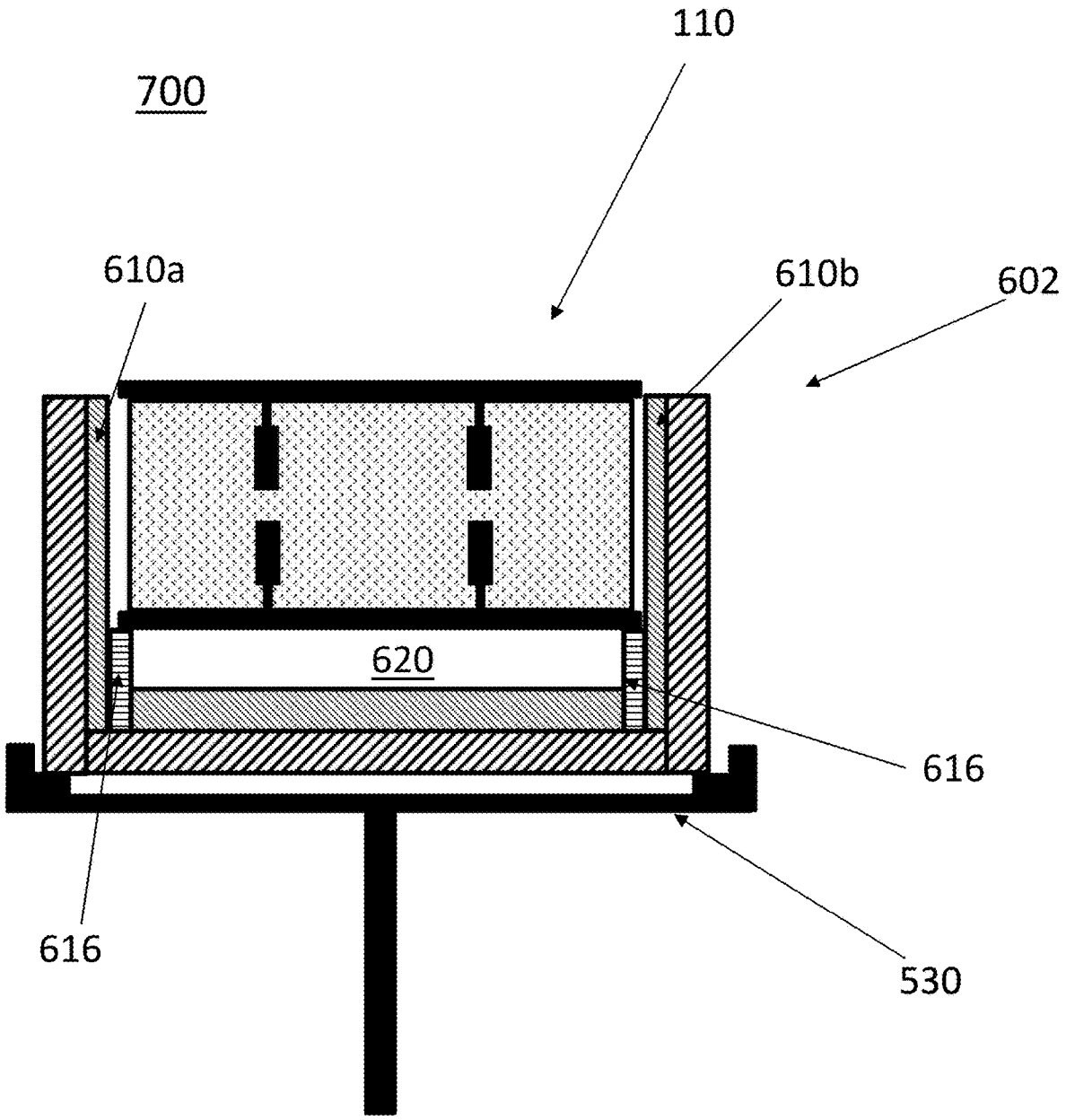

FIGS. 6-7 illustrate a second embodiment of the invention that is designed to reduce an amount (volume) of acoustic energy (sound) that transmits away from a vicinity, being a volume of space that is proximate to a drum, such as the drum 110 of FIG. 1, in response to striking the drum. Like the first embodiment 402 that is described in association with FIGS. 4-5, this embodiment 602 is designed to reduce an amount of acoustic energy (volume of sound) that transmits away from a vicinity of the drum, while avoiding physical contact with either the upper drumhead 112 or the lower drumhead 222 of the drum 110.

FIG. 6 illustrates a side cross-sectional view of a second embodiment 602 of the apparatus of the invention. As shown, the second embodiment 602 being cylindrical in shape and designed to surround a substantial portion of a drum, incorporates the components of the first embodiment 402 of FIG. 4, and further includes a base 612 having side walls 618 that surround the shell 120 of the drum, and having additional sound absorbing material 610 that is abutting the side walls 618 and that surround the shell 120 of the drum 110.

The profile of this embodiment 602 appears circular, either from a top-down perspective, or from a bottom-up perspective, being perpendicular relative to this side cross-sectional viewing perspective. The side walls 618 and additional sound absorbing material 610 are configured (sized and shaped) to form a cavity 620 within which a drum, such as the drum 110, can be disposed. The cavity 620 is configured (designed) to substantially surround a drum, such as the drum 110, while allowing the upper drumhead 112 of the drum 110 to be sufficiently exposed to facilitate striking of the drum via a drumstick 330.

As shown in FIG. 7, the drum 110 is disposed within the cavity 620 shown in FIG. 6. In this second embodiment 602, the base 612 is designed (sized and shaped) to include a cavity 620 within which a drum, such as the drum 110, is disposed. This embodiment is designed to reduce an amount of acoustic energy (volume of sound) that is generated away from a volume of space that is proximate to the drum via the lower drumhead 222 and to reduce sound that is generated away from a volume of space that is proximate to the shell 120 of the drum 110. Such sound is typically generated via a strike to the upper drumhead 112 via a drumstick.

Also, as shown in FIG. 7, the lower rim 224 of the drum 110 is disposed upon and makes physical contact with the separation components 616 of the second embodiment of the apparatus 602 shown in FIG. 6. Also, the apparatus 602 of FIG. 6, is shown to be disposed upon a drum stand 530. As shown here, the separation components 616 provide support to the drum 110 from gravity. In alternative embodiments, the separation components 616 can be configured to include a cavity (not shown here) that receives an outer edge of the lower rim 224 of the drum 110, so as to further restrict lateral movement of the drum 110, while it is disposed upon and within the cavity 620 of the apparatus 602 of FIG. 6.

Figure 8:
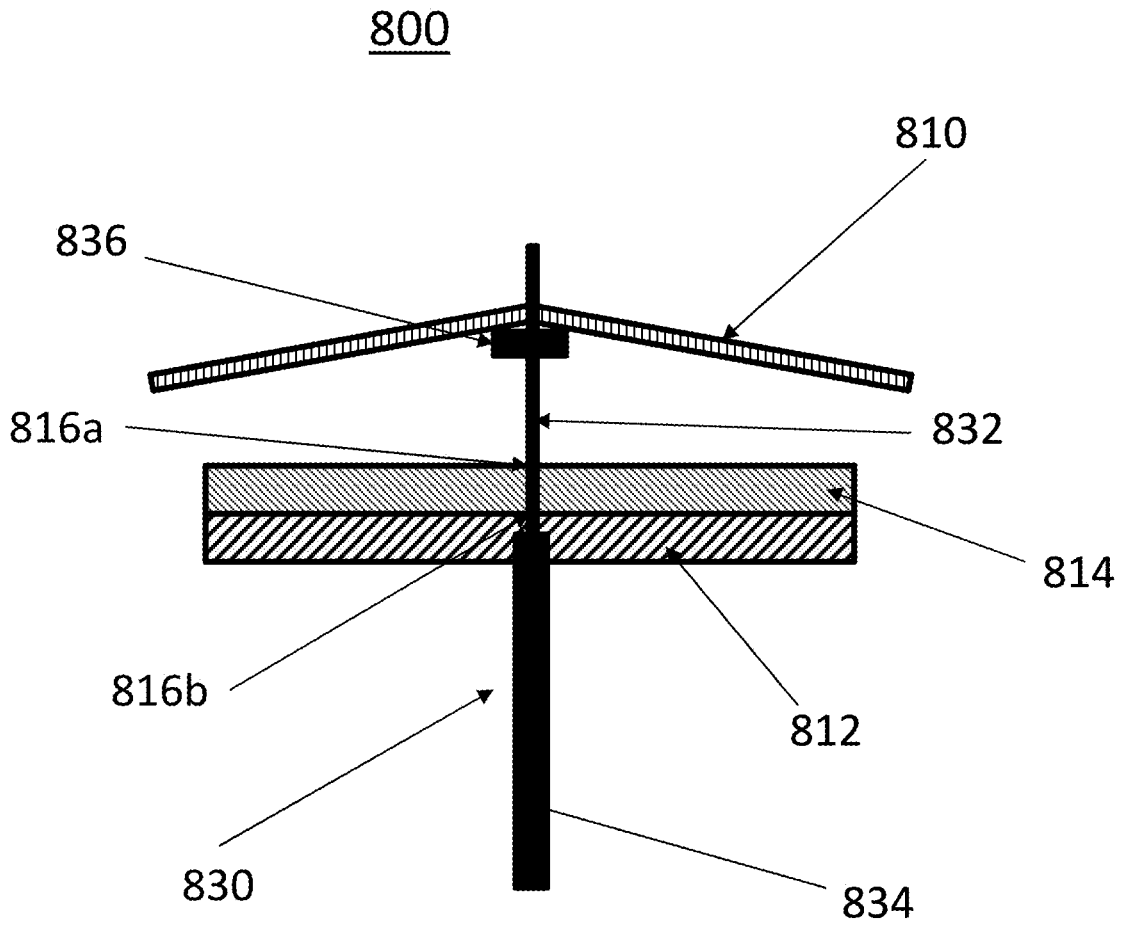
FIG. 8 illustrates a third embodiment that is designed to reduce a volume of acoustic energy (sound) that transmits away from a vicinity of a cymbal.

FIG. 8 illustrates a third embodiment of the invention that is designed to reduce an amount (volume) of acoustic energy (sound) that transmits away from a proximate area surrounding a cymbal 802, in response to striking the cymbal 802. Like other embodiments that are described within this document, this third embodiment is designed to reduce an amount of sound transmitting away from the vicinity of the cymbal 802, while avoiding physical contact with the cymbal 802, in order to minimize an affect upon the resonance of the cymbal 802 and to minimize an effect upon the characteristics of the sound generated by the cymbal 802. In other words, minimizing physical contact with the cymbal is intended to preserve characteristics of the sound that would otherwise be generated by the cymbal 802, when the cymbal 802 is struck, for example, with a drumstick 330.

As shown, a cymbal 810 is supported on a cymbal stand 830, which includes a cymbal support 836, both of which support the cymbal 810 from gravity. The cymbal stand 830 is constructed from at least two posts of varying width. A relatively narrow post 832 slides within a relatively wider post 834. In accordance with the invention, a sound absorbing component 814 is disposed upon a base 812, while the base 812 is supported from gravity by the wider post 834 of the cymbal stand 830.

The base 812 and the sound absorbing component 814 each include a narrow center hole 816*a* that permits passage of the narrow post 832, but that does not permit passage of the wider post 834. The narrow hole 816*a* is accessed from an upper side of the base 812 and it includes an expansion point within the base 812. At the expansion point, the narrow hole 816*a* expands into the wider hole 816*b*. The wider hole 816*b* can be accessed on a lower side of the base 812. The wider hole 816*b* permits passage of the wider post 834, partially through the base 812. However, passage of the wider post 834 through the base 812 is arrested at the expansion point, enabling the base 812 to rest upon and to be supported from gravity by the wider post 834, in proximity to and below the cymbal 810.

The location of the base 812 enables the sound absorption component to be disposed within proximity to, such as within (2) inches of a lower surface of the cymbal 810, and to absorb sound that is generated by the cymbal 810 when the cymbal is struck, for example, by a drumstick 330. While absorbing sound generated by the cymbal 810, neither the sound absorbing component 814 nor the base 812 are in physical contact with the cymbal 810.

The purpose of avoiding such physical contact with the cymbal 810, is to minimize an effect upon the characteristics of the sound generated by the cymbal 810, while reducing an amount of the sound transmitting away from the vicinity of the cymbal 810. In other words, minimizing physical contact with the cymbal 810 is intended to limit an amount of change to the characteristics, of the sound that would otherwise be generated by the cymbal 810, when the cymbal 810 is struck.

In some embodiments, the base 812 and the sound absorbing component 814 are constructed as one combined component. In some embodiments, this one combined component is shaped and dimensioned as a combination of the base 812 and the sound absorbing component 814, as shown in FIG. 8. In this type of embodiment, whether the combined component is dimensioned as shown in FIG. 8 or dimensioned and/or shaped otherwise, the base component 812 and the sound absorbing component 814 are made (constructed) as the same one component.

Alternatively, in some embodiments, the base 812 component is attached to the cymbal stand via a clamping mechanism. This clamping mechanism is designed to grip and attach to the cymbal stand 830, and enables the proximity of the base component 812 and the sound absorbing component 814 relative to the cymbal to be variably positioned and adjusted along a long dimension of the cymbal stand 830.

Figure 9A:
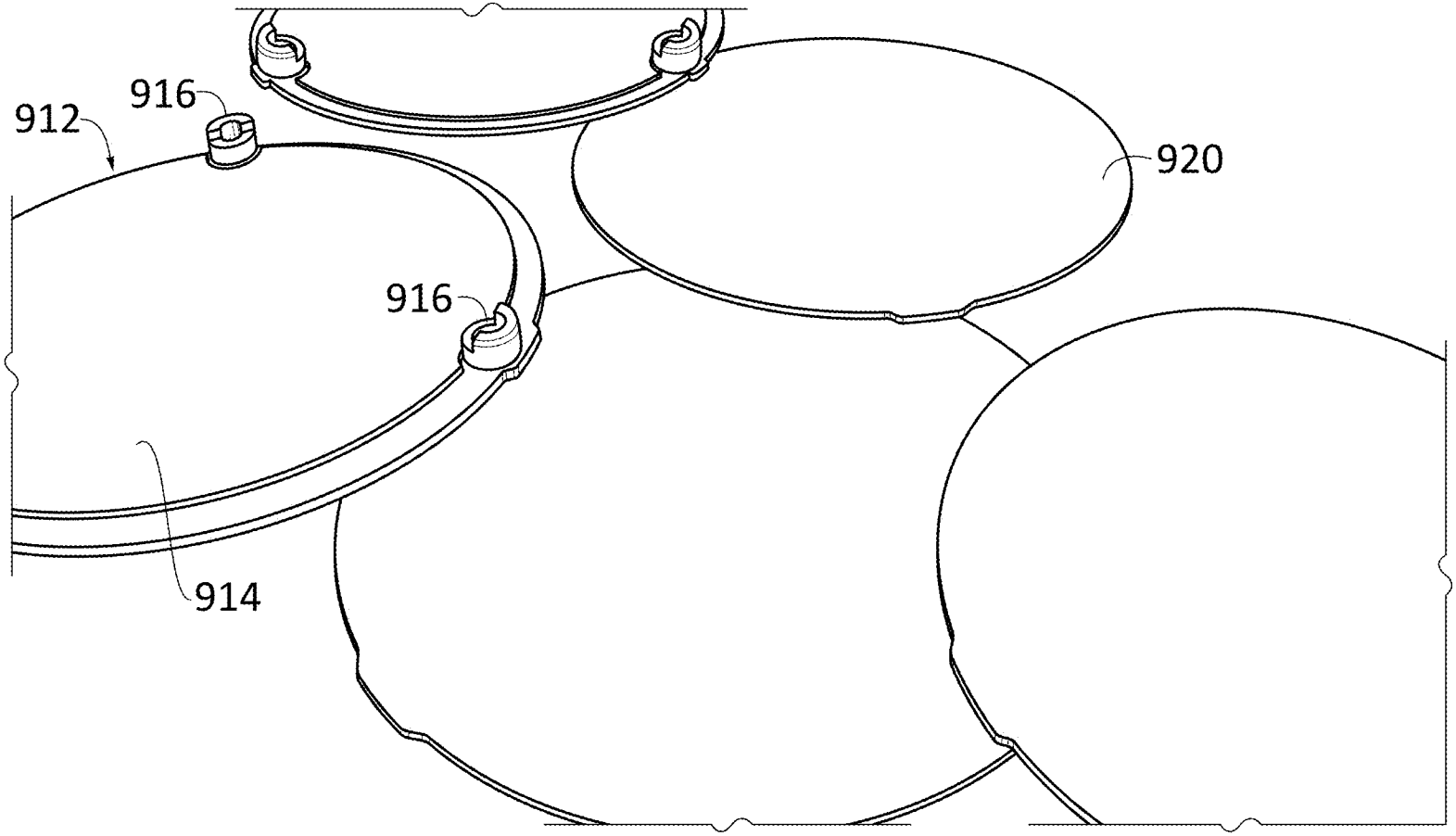
FIGS. 9A-9C illustrate an embodiment that is disposed in between a top of a drum stand and a drum that is mounted on the drum stand.
Figure 9B:
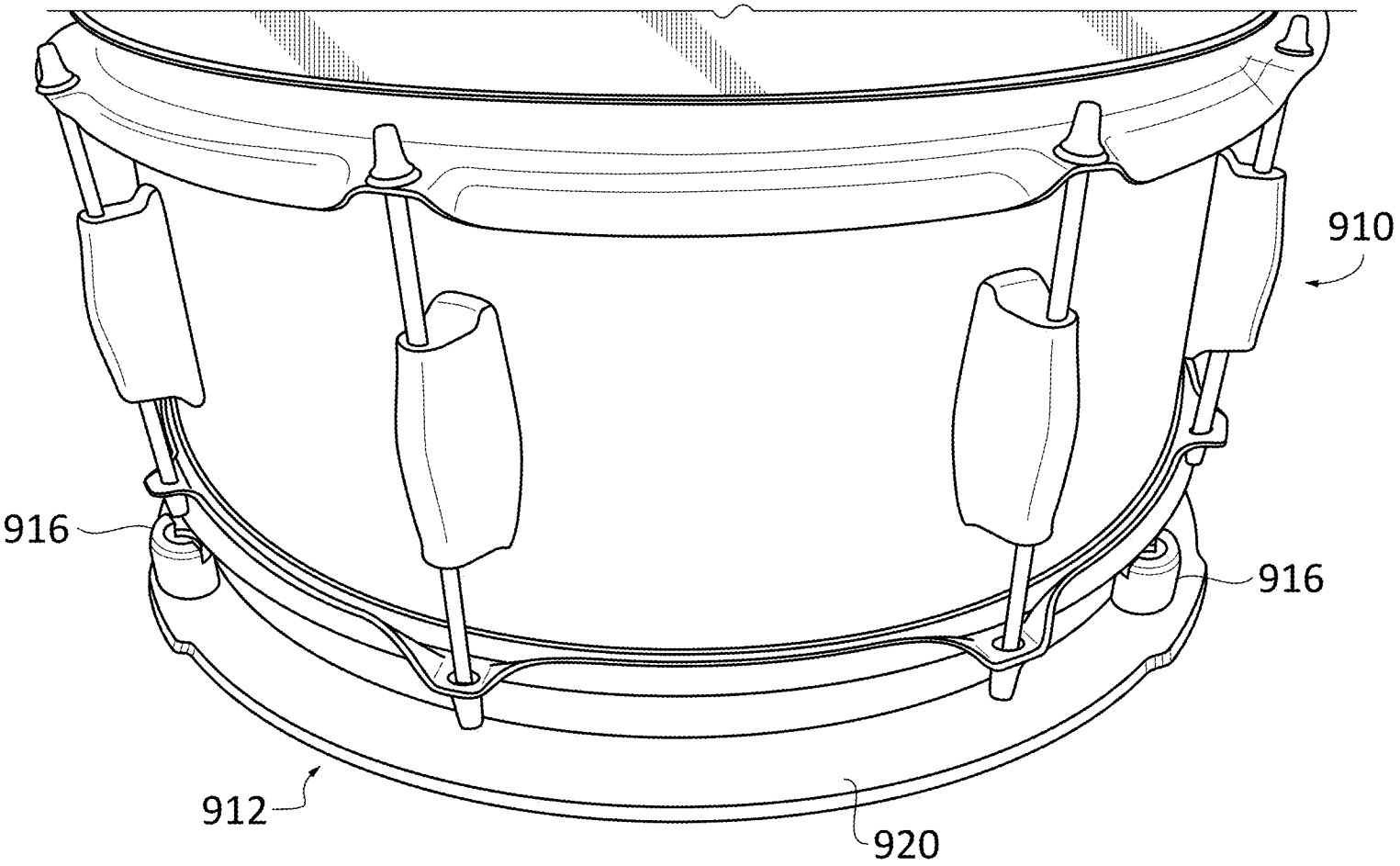
Figure 9C:
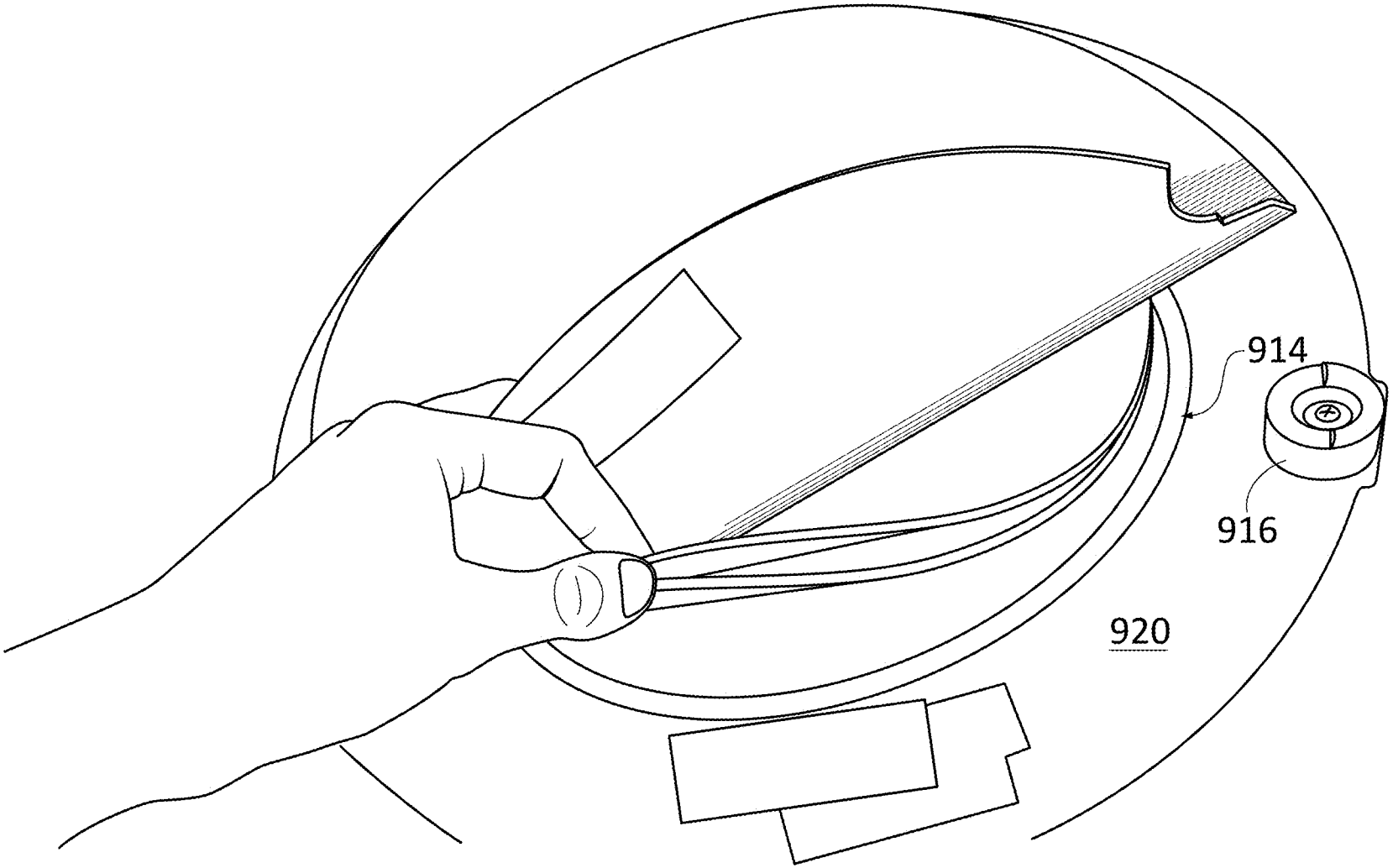

FIGS. 9A-9C illustrate an embodiment of the invention that is disposed on top of a drum stand and upon which a drum is mounted. In other words, the embodiment is designed to be sandwiched in between the top of the drum stand and the drum, like shown in FIG. 5.

As shown in FIG. 9A, a base 912 has a generally planar and circular shape, and is attached to (3) upward protruding separators 916, also referred to herein as spacers 916. Note that from this FIG. 9A viewing perspective, at most, two of three upward protruding spacers for any one base 912 are shown here. Preferably, the three protruding spacers 916 for each base 916 are located equidistant from each other. In other embodiments, more than three spacers 916 can be employed.

In this embodiment, each spacer is cylindrical in shape. The base 912 has a slightly narrower diameter at locations in between each pair of the spacers 916. The slightly narrower diameter of the base 912 is designed to provide space for a drum stand prong (not shown here) to be positioned along and above the perimeter of the base 912, and to enable physical contact between each drum stand prong (not shown here) and a drum shell (not shown here) that is positioned above the base 912. Each drum stand prong is disposed at locations along the perimeter of the base 912 that reside in between each pair of spacers 916.

As shown, the base 912 is composed of a painted particle board 920 upon which is attached a portion of floor carpeting 914. The floor carpeting is cut into a generally circular shape having a diameter that is limited in size so as to enable the portion of floor carpeting to fit in between the (3) three separators 916 that are attached to and protruding from each base 912 that is constructed from the particle board 920.

FIG. 9B illustrates a drum 910 that is disposed on top of spacers 916 protruding from the base 912 of FIG. 9A. In variations of this embodiment, a groove or crevice is cut into each spacer 916 so that the narrow outer bottom rim of the drum 910 can be tucked into and disposed inside of such a groove or crevice.

FIG. 9C illustrates a sound absorbing component 914 having multiple layers of material. Each layer is configured to contribute to a collective set of sound absorbing characteristics of the sound absorbing component as a whole.

Figure 10:
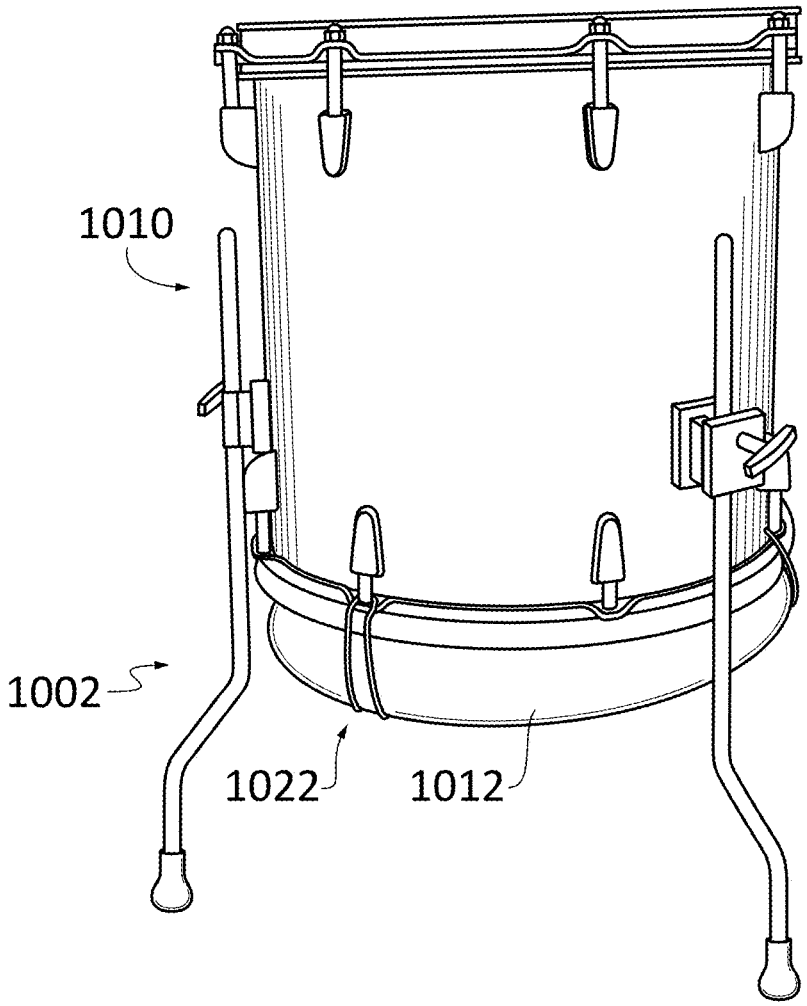
FIG. 10 illustrates an embodiment that is suspended below a lower rim of a drum.

FIG. 10 illustrates an embodiment of the invention 1002 that is disposed below a lower drumhead of a floor mounted drum 1010. As shown, a base 1012 is tethered and suspended from gravity below the floor mounted drum 1010 via flexible bands 1022. The flexible bands 1022 attach the base 1012 to the lug and lug screw hardware of the drum 1010 itself. Other types of tether, such as for example, employment of a rope, string, wire or cable, can be utilized to suspend from gravity, and to retain the base 1012 to a particular location relative to the drum 1010.

In this particular embodiment, the base 1012 is made from wood, and the sound absorbing component is made from floor carpeting. The sound absorbing component is preferably located about 1-2 inches from the lower drumhead and is physically separated by from the lower drumhead of the drum 1010 via separators. A pocket of air resides in between the lower drumhead and the sound absorbing component.

In this embodiment, the separators are designed as long and narrow cylindrical objects that span the outer circumference of the lower rim of the drum 1010. These particular separators make physical contact with both the lower rim and the sound absorbing component. In this particular embodiment, drumsticks are employed to function as these long cylindrical objects. But many other objects could be instead implemented as separators.

In other variations of this embodiment, either other types of separators can be employed to ensure that the sound absorbing component does not make physical contact with the lower drumhead of the drum 1010, or no separators are employed and the base 1012 and the sound absorbing component are suspended a distance away from and below the lower drumhead, while employing gravity for separation, and without necessarily employing other objects as separators to ensure physical separation between the sound absorbing component and the lower drumhead of the drum 1010.

In other embodiments, a drum rim is designed to better accommodate mounting of an embodiment of the invention. Instead of having a sharp outer edge, like on a normal rim of a drum, the rim of a drum could instead have a flat annulus region with rubber pads or a rubber annulus that an embodiment of the invention is pressed against. In other words, drum design could evolve to better accommodate the types of functions being carried out by various embodiments of this invention.

Measurements of sound reduction indicate that a first sound reduction embodiment including a base that is made from particle board, also referred to as medium density fiber board (MFD) (See FIGS. 9A-9C) and being about one quarter inch thick and that is attached to a sound absorption component made from floor carpeting, both being of a generally circular shape and having a diameter of a length that is about equal to that of a snare drum, reduced a volume of sound transmitting from the snare drum and passing through this sound reduction embodiment by about (6) decibels (dB), which is equal to about a 75% reduction of the volume of sound transmitting through this sound reduction embodiment. The sound was measured via a microphone that was located about 6 inches below the snare drum while the sound reduction embodiment was located about 2 inches below the snare drum.

When employing a second sound reduction embodiment that includes a base being made from wood and instead being about 1 inch thick, the same measurement that is described in the paragraph above yielded a measured sound reduction of about (9) decibels (dB), which is equal to about an 88% reduction of the volume of sound transmitting entirely through this second sound reduction embodiment.

Ideally, a sound absorbing component should be located within a distance of one inch or less of a resonating portion of a percussion instrument, without making physical contact with the resonating portion of a percussion instrument, in order to maximize an amount of sound (acoustic energy) traveling through both the base and the sound absorbing component. However, the base and sound absorbing component embodiments of the invention can work effectively at distances that are farther, for example, as far as 10 inches from a resonating portion of a percussion instrument.

For example, as referred to herein, a resonating portion of a percussion instrument includes a resonating membrane, such as a drum head of a drum, whether or not that particular drum head of that drum has been physically struck by another object to cause that particular drum to resonate. More specifically, a lower drumhead of a drum is considered herein a resonating portion of that drum when an upper drumhead of that same drum is stuck by another object, such as by a drum stick, causing that drum to resonate.

However, as referred to herein, non-membrane portions of a drum 110, such as a shell 120, a lug 118 or a lug screw 116 portion of a drum 110, are not referred to herein as a resonating membrane, and are not referred herein to as being a resonating portion of a drum 110, even though some resonance may occur within the shell 120, lug 118 or lug screw 116. Nor is a drum stand 530 or portions thereof, referred to herein as a resonating portion of a drum 110.

With respect to a cymbal 810 as a percussion instrument, as referred to herein, a cymbal 810 itself, is referred to herein a resonating portion of a percussion instrument, considering that the cymbal 810 resonates when stuck by another object, such as when being struck by a drumstick. However, as referred to herein, a cymbal support 832 or a cymbal stand 834, or portions thereof, for example, are not referred to herein as a resonating portion of a percussion instrument.

Note that a structure that is designed to support a percussion instrument from gravity, is referred to herein as a supporting structure. For example, a drum stand and a cymbal stand are referred to herein as supporting structures, regardless of whether the drum stand or the cymbal stand are designed to be floor standing, or not designed to be floor standing. Note that some supporting structures are designed to be attached to other structures. For example, a drum supporting structure can be attached to another drum, such as a floor mounted base drum.

Preferably, the sound absorbing component is located near proximate to the resonating portion of a percussion instrument, where "near proximate" is intended to mean being located (3) inches or less, from a resonating portion of a percussion instrument, without making physical contact with the instrument. Preferably, each type and amount of material within the sound absorbing component has at least minimal sound absorbing properties, where "minimal sound absorbing properties" is referring that the type of material, in an amount that is residing within the sound absorbing component, that reduces (absorbs or attenuates), a volume of sound passing through the material by an amount of at least 3%.

However, multiple layers of a particular type of material that are contiguously or non-contiguously stacked within the sound absorbing component, can collectively increase sound attenuation of a particular type of material that is residing within the sound absorbing component to above 3%, even though each individual layer of this type of material, by itself, may fall short of 3% sound attenuation.

Also, the sound absorbing component is preferably shaped to include a planar side that is oriented perpendicular to a direction of sound that is being transmitted away from a nearest resonating portion of a percussion instrument, and dimensioned so that such a planar area can substantially or entirely span at least the nearest resonating portion of a percussion instrument, such as a drum head, for example.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for reducing a volume of a sound generated by a percussion instrument, comprising:

at least one sound absorbing component, said sound absorbing component being constructed from a set of one or more materials, and wherein at least some of said materials having sound absorbing properties;

a base component that is configured for retaining said sound absorbing component at a location that is adjacent to or near proximate to said base component; and wherein said base component is designed to be supported from gravity by a supporting structure; and wherein no portion of the apparatus is configured for making physical contact with a resonating portion of the percussion instrument.

2. The apparatus of claim 1 wherein said base component and said sound absorbing component are the same component.

3. The apparatus of claim 1 wherein a resonating portion of the percussion instrument is a drum head.

4. The apparatus of claim 1 wherein a resonating portion of the percussion instrument is a cymbal.

5. The apparatus of claim 1 wherein said supporting structure is a floor standing structure, such as a drum stand or a cymbal stand.

6. The apparatus of claim 1 wherein said supporting structure is a tether.

7. The apparatus of claim 1 that is configurable so that said sound absorbing component is disposed within a range of proximity of three inches or less from a lower surface of a resonating portion of a percussion instrument.

8. A method for reducing a volume of a sound generated by a percussion instrument, comprising:

providing at least one sound absorbing component, said sound absorbing component being constructed from a set of one or more materials, and wherein at least some of said materials having sound absorbing properties;

providing a base component that is configured for retaining said sound absorbing component at a location that is adjacent to or near proximate to said base component; and wherein said base component is designed to be supported from gravity by a supporting structure cymbal stand; and wherein no portion of the apparatus is configured for making physical contact with a resonating portion of the percussion instrument.

9. The method of claim 8 wherein said base component and said sound absorbing component are the same component.

10. The method of claim 8 wherein a resonating portion of the percussion instrument is a drum head.

11. The method of claim 8 wherein a resonating portion of the percussion instrument is a cymbal.

12. The method of claim 8 wherein said supporting structure is a floor standing structure, such as a drum stand or a cymbal stand.

13. The method of claim 8 wherein said supporting structure is a tether.

14. The method of claim 8 that is configurable so that said sound absorbing component is disposed within a range of proximity of three inches or less from a lower surface of a resonating portion of a percussion instrument.

15. The apparatus of claim 1 where said base component is clamped to a supporting structure.

16. The apparatus of claim 1 including a separator and wherein said separator includes a groove to engage with a rim of a drum.

17. The apparatus of claim 1 wherein said sound absorbing component includes a floor carpet like layer.

18. The apparatus of claim 1 that is configurable so that said sound absorbing component is disposed within a range of proximity of two inches or less from a lower surface of a resonating portion of a percussion instrument.

19. The apparatus of claim 1 that is configurable so that said sound absorbing component is disposed within a range of proximity of six inches or less from a lower surface of a resonating portion of a percussion instrument.

20. The apparatus of claim 1 that is configurable so that said sound absorbing component is disposed within a range of proximity of ten inches or less from a lower surface of a resonating portion of a percussion instrument.

* * * * *